US007584627B2

(12) United States Patent
Sim et al.

(10) Patent No.: US 7,584,627 B2
(45) Date of Patent: Sep. 8, 2009

(54) REFRIGERATOR

(75) Inventors: Jae Sung Sim, Gyeongsangnam-Do (KR); Jong Min Shin, Busan-Si (KR); Young Hwan Ko, Seoul (KR)

(73) Assignee: LG Electronics Inc., Seoul (KR)

( * ) Notice: Subject to any disclaimer, the term of this patent is extended or adjusted under 35 U.S.C. 154(b) by 507 days.

(21) Appl. No.: 10/537,828

(22) PCT Filed: Dec. 16, 2003

(86) PCT No.: PCT/KR03/02749

§ 371 (c)(1),
(2), (4) Date: Jun. 8, 2005

(87) PCT Pub. No.: WO2004/059227

PCT Pub. Date: Jul. 15, 2004

(65) Prior Publication Data

US 2006/0005568 A1 Jan. 12, 2006

(30) Foreign Application Priority Data

Dec. 24, 2002 (KR) ..... 10-2002-0083289

(51) Int. Cl.
*F25D 17/04* (2006.01)
*F25D 17/06* (2006.01)
*F25D 11/02* (2006.01)

(52) U.S. Cl. ..... 62/407; 62/419; 62/441

(58) Field of Classification Search ..... 62/419, 62/404, 407, 426, 408, 441
See application file for complete search history.

(56) References Cited

U.S. PATENT DOCUMENTS

| | | | | |
|---|---|---|---|---|
| 3,252,292 | A * | 5/1966 | O'Connell et al. | 62/77 |
| 4,891,952 | A * | 1/1990 | Yoshikawa et al. | 62/199 |
| 4,924,680 | A * | 5/1990 | Janke et al. | 62/187 |
| 5,706,671 | A * | 1/1998 | Lee et al. | 62/407 |
| 5,765,388 | A | 6/1998 | Jeon | |
| 5,816,060 | A | 10/1998 | Brownell et al. | |
| 6,112,546 | A * | 9/2000 | Kim | 62/440 |

FOREIGN PATENT DOCUMENTS

| | | | |
|---|---|---|---|
| EP | 0464711 A | | 1/1992 |
| JP | 55075138 | * | 6/1980 |

* cited by examiner

*Primary Examiner*—William C Doerrler
(74) *Attorney, Agent, or Firm*—Birch, Stewart, Kolasch & Birch, LLP

(57) ABSTRACT

Refrigerator including a freezing chamber (1), a refrigerating chamber (2) at a side of the freezing chamber, a barrier (303) between the freezing chamber and the refrigerating chamber, the barrier having a freezing chamber cold air passage (A) formed therein, a partition plate (7) for compartmentalizing a freezing chamber cold air passage in rear of the freezing chamber where an evaporator (104) is positioned, the evaporator provided in a "¬" form along the freezing chamber cold air passage (A) and the refrigerating chamber cold air passage (B), a partition wall (9) between the freezing chamber cold air passage and the refrigerating chamber cold air passage, and a fan (305) mounted over the freezing chamber cold air passage and the refrigerating chamber cold air passage for discharging cold air flowing through respective cold air passage (10) to the freezing chamber and the refrigerating chamber respectively, thereby improving a cooling rate of the refrigerating chamber and providing more efficient refrigerator.

29 Claims, 9 Drawing Sheets

REFRIGERATOR

TECHNICAL FIELD

The present invention relates to refrigerators, and more particularly, to an independent cooling type refrigerator, in which a refrigerating chamber and a freezing chamber are cooled independently.

BACKGROUND ART

In general, the refrigerator cools down an inside thereof by repeating a refrigerating cycle in which refrigerant is compressed, condensed, and evaporated, for fresh conservation of food stored therein for a time period.

The refrigerator is provided with a compressor, a condenser, an expansion valve, and an evaporator. The compressor boosts low temperature/low pressure gas refrigerant to high temperature/high pressure gas refrigerant. The condenser condenses the refrigerant introduced thereto from the compressor by using outdoor air. The expansion valve has a diameter smaller than a diameter of other part, for dropping a pressure of the refrigerant introduced thereto from the condenser. The evaporator absorbs heat an inside of the refrigerator as the refrigerant passed through the expansion valve evaporates in a lower pressure state.

The structure and operation of a general side by side type refrigerator will be described with reference to the attached drawings.

Referring to FIG. 1, the refrigerator is provided with a freezing chamber 1 for receiving most of cold air heat exchanged at the evaporator 4 to maintaining an inside temperature thereof at approx. −18° C., and a refrigerating chamber for receiving rest of the cold air heat exchanged at the evaporator 4 for maintaining an inside temperature thereof at approx. 0~7° C. The freezing chamber 1 and the refrigerating chamber 2 is arranged side by side on left and right sides in parallel.

The freezing chamber 1 and the refrigerating chamber 2 are partitioned with a barrier 3, wherein the barrier 3 has a hole 3*a* in an upper part of rear thereof for supplying the cold air heat exchanged at the evaporator 4 to the refrigerating chamber, and a hole 3*b* in a lower part thereof for supplying cold air circulated through the refrigerating chamber 2 to be heated to a relatively high temperature to the freezing chamber 1 again. The hole 3*a* for supplying the cold air to the refrigerating chamber is provided with a damper (not shown) on an inside thereof for controlling flow of the cold air introduced into the refrigerating chamber 2.

Referring to FIGS. 2A and 2B, there are a fan 6 over the evaporator 4 for forced circulation of the cold air cooled at the evaporator to the freezing chamber 1, and a motor for driving the fan. There is a cold air passage 10 compartmentalized by a partition plate 7 in front of the evaporator 4 for separating the freezing chamber from a space the evaporator 4 is mounted therein.

The partition plate 7 has a two layered plate structure with a front plate 7*a* and a rear plate 7*b*, between which the cold air passage 10 is formed.

The front plate 7*a* has a plurality of cold air outlets 11 in communication with the freezing chamber, and there are cold air inlets 13 under the partition plate 7 for introduction of the cold air circulated through the freezing chamber 1 to absorb heat into the evaporator 4 again, and a machinery room 5 in a lower part of rear of the freezing chamber 1.

Upon applying power to the refrigerator in a state food is stuffed in the freezing chamber 1 and the refrigerating chamber 2 of the refrigerator, as the compressor in the machinery room is operated in response to a control signal from a controller (not shown), a heat exchange environment of the evaporator 4 is controlled by the refrigerating cycle described before.

Accordingly, the cold air passed through the evaporator 4 is cooled down by means of heat exchange at the evaporator, and discharged to the cold air passage 10 on the freezing chamber side by operation of the fan 6. The discharged cold air is introduced into the freezing chamber 1 through the cold air outlets 11, and a portion of which is introduced into the refrigerating chamber 2 through the holes 3*a*. Thereafter, the cold air circulated through the freezing chamber 1 and the refrigerating chamber 2 to absorb heat is introduced into the evaporator 4 through the cold air inlets 13 again and heat exchanges at the evaporator 4, thereby forming a cold air circulating system.

As has been described, because the related art refrigerator has a structure in which the evaporator 4 is mounted only on the freezing chamber side, and a portion of the cold air having heat exchanged at the evaporator 4 is introduced into the refrigerating chamber 2 through the cold air passage 10 on the freezing chamber side, the related art refrigerator has the following problems.

First, since the compressor and the fan are required to come into operation again for temperature control of either the freezing chamber 1 or the refrigerating chamber 2, if an inside temperature of any one of the freezing chamber 1 and the refrigerating chamber 2 fails to meet a preset temperature, unnecessary consumption of power is caused.

For an example, if the temperature of the refrigerating chamber 2 fails to meet the preset temperature even if the temperature of the freezing chamber 1 meets the preset temperature, it is required to put the compressor and the fan into operation, to cool down the temperature of the refrigerating chamber for meeting the preset temperature of the refrigerating chamber. In this instance, since the cold air is also, supplied to the freezing chamber 1 unnecessarily, of which temperature condition is met already, power is consumed unnecessarily.

Second, there has been shortage of cold air passed through the evaporator 4 and supplied to the refrigerating chamber 2 to cause a problem of relatively lower cooling rate of the refrigerating chamber 2 than the cooling rate of the freezing chamber 1.

That is, even if the refrigerating chamber 2 is set to a temperature higher than the freezing chamber 1, the cooling rate is poor because of shortage of the flow.

Third, the thickness of the evaporator 4 mounted in rear of the freezing chamber 1 reduces a volume of the freezing chamber, causing inefficient use of the space.

DISCLOSURE OF INVENTION

An object of the present invention is to provide a refrigerator which can improve cooling efficiency, and reduce a power consumption, and improves a cooling rate of the refrigerating chamber.

Other object of the present invention is to provide a refrigerator which can increase volumes of the chambers of the refrigerator along with accomplishment of above object.

To achieve the objects of the present invention, there is provided a refrigerator including a freezing chamber, a refrigerating chamber at a side of the freezing chamber, a barrier between the freezing chamber and the refrigerating chamber, the barrier having a freezing chamber cold air passage formed therein, a partition plate for compartmentalizing a freezing chamber cold air passage in rear of the freezing chamber where an evaporator is positioned, the evaporator provided in a "¬" form along the freezing chamber cold air passage and the refrigerating chamber cold air passage, a partition wall between the freezing chamber cold air passage and the refrigerating chamber cold air passage, and a fan mounted over the freezing chamber cold air passage and the refrigerating chamber cold air passage for discharging cold air flowing through respective cold air passages to the freezing chamber and the refrigerating chamber, respectively.

The evaporator includes a first part exposed to the freezing chamber cold air passage, and a second part exposed to the refrigerating chamber cold air passage. The first part is larger than the second part, and the first part and the second part are separated by the partition wall for preventing the cold air flowing through respective parts from mixing with each other.

The partition plate includes a front plate and a rear plate, to form a cold air passage between the plates. The front plate has a plurality of cold air discharge openings formed therein, the rear plate has an opening in an upper part thereof, the fan is provided adjacent to the opening, and the partition plate has openings in a lower part thereof to form cold air suction openings.

The fan is a cross flow fan, and the cross flow fan has one side exposed to the freezing chamber cold air passage, and the other side exposed to the refrigerating chamber cold air passage. The first part is separated from the second part by a separation plate.

The refrigerating chamber cold air passage has a cold air discharge opening above a part adjacent to the cross flow fan. The cold air discharge opening has a damper provided thereto for opening/closing the cold air discharge opening.

The barrier has cold air suction openings in a lower part of a refrigerating chamber side thereof in communication with the refrigerating chamber cold air passage. The evaporator is an one layered fin-tube type heat exchanger.

In other aspect of the present invention, there is provided a refrigerator including a freezing chamber, a refrigerating chamber at a side of the freezing chamber, a barrier between the freezing chamber and the refrigerating chamber, the barrier having a freezing chamber cold air passage formed therein, a partition plate for compartmentalizing a freezing chamber cold air passage in rear of the freezing chamber where an evaporator is positioned, the evaporator provided in a "¬" form along the freezing chamber cold air passage and the refrigerating chamber cold air passage, a partition wall between the freezing chamber cold air passage and the refrigerating chamber cold air passage, and fans respectively provided to the freezing chamber cold air passage and the refrigerating chamber cold air passage for forced circulation of cold air to the freezing chamber and the refrigerating chamber, respectively.

The freezing chamber cold air passage and the refrigerating chamber cold air passage are in communication with each other at one sides thereof, and a damper is provided in a part of the communication is made.

The fan in the freezing chamber cold air passage is an axial flow fan, and the fan in the refrigerating chamber cold air passage is a cross flow fan.

BRIEF DESCRIPTION OF THE DRAWINGS

The accompanying drawings, which are included to provide a further understanding of the invention, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings FIGS. 3 to 8. In describing the embodiments of the present invention, same parts will be given the same names and reference symbols, and repetitive description of which will be omitted.

Figure 1:
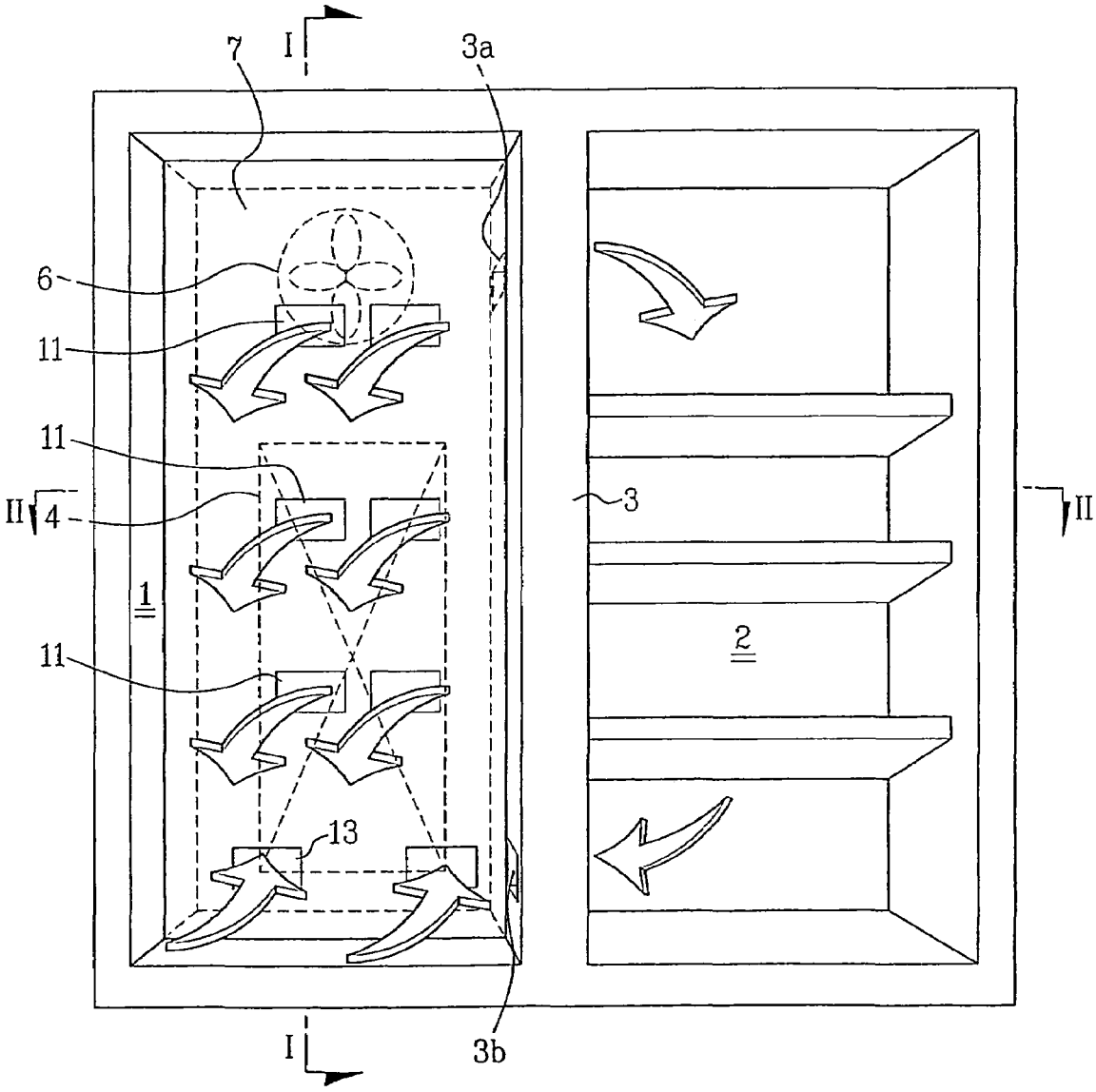
FIG. 1 Prior Art
FIG. 1 illustrates a perspective view of a related art refrigerator.
Figure 2A:
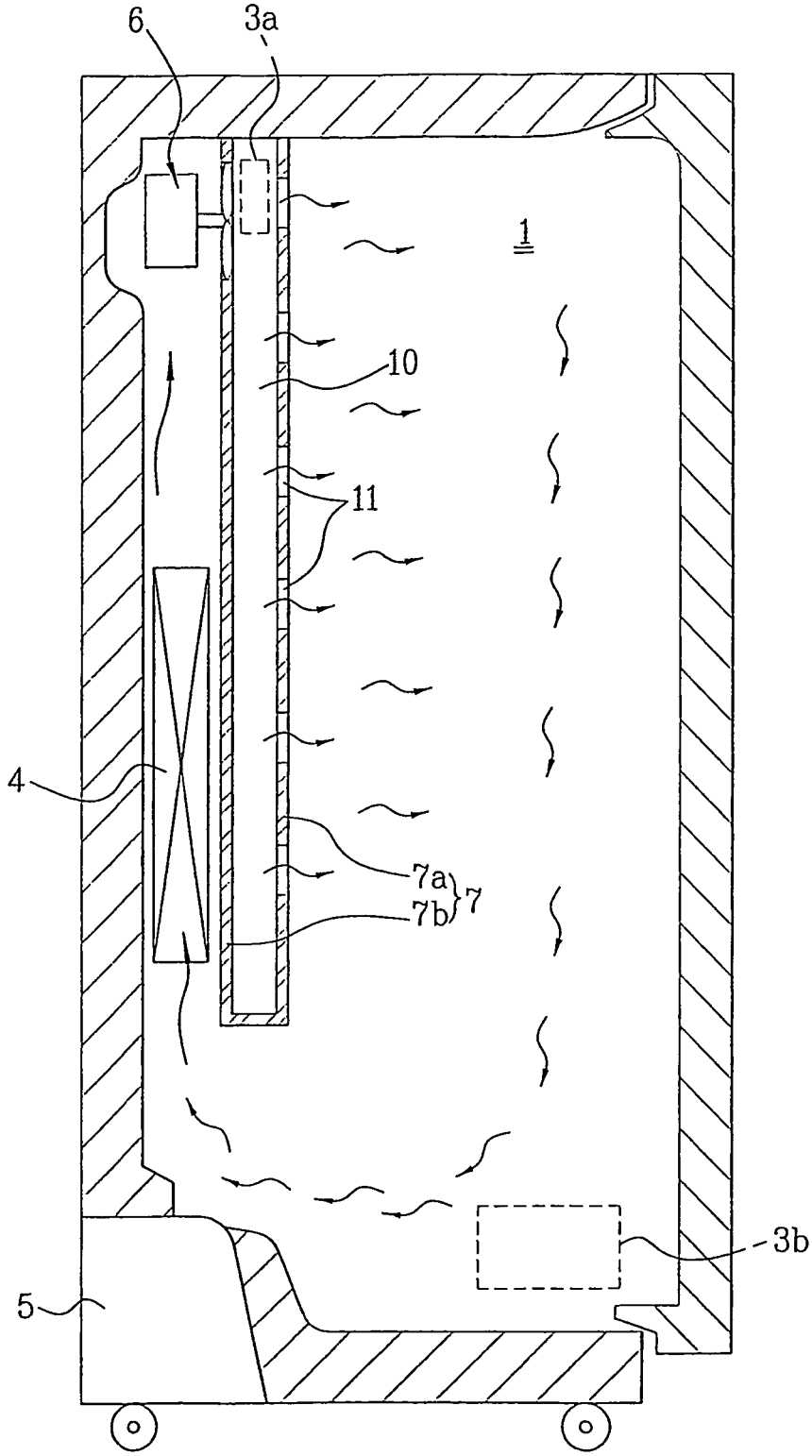
FIG. 2A Prior Art
FIG. 2A illustrates a section across a line I-I in FIG. 1.
Figure 2B:
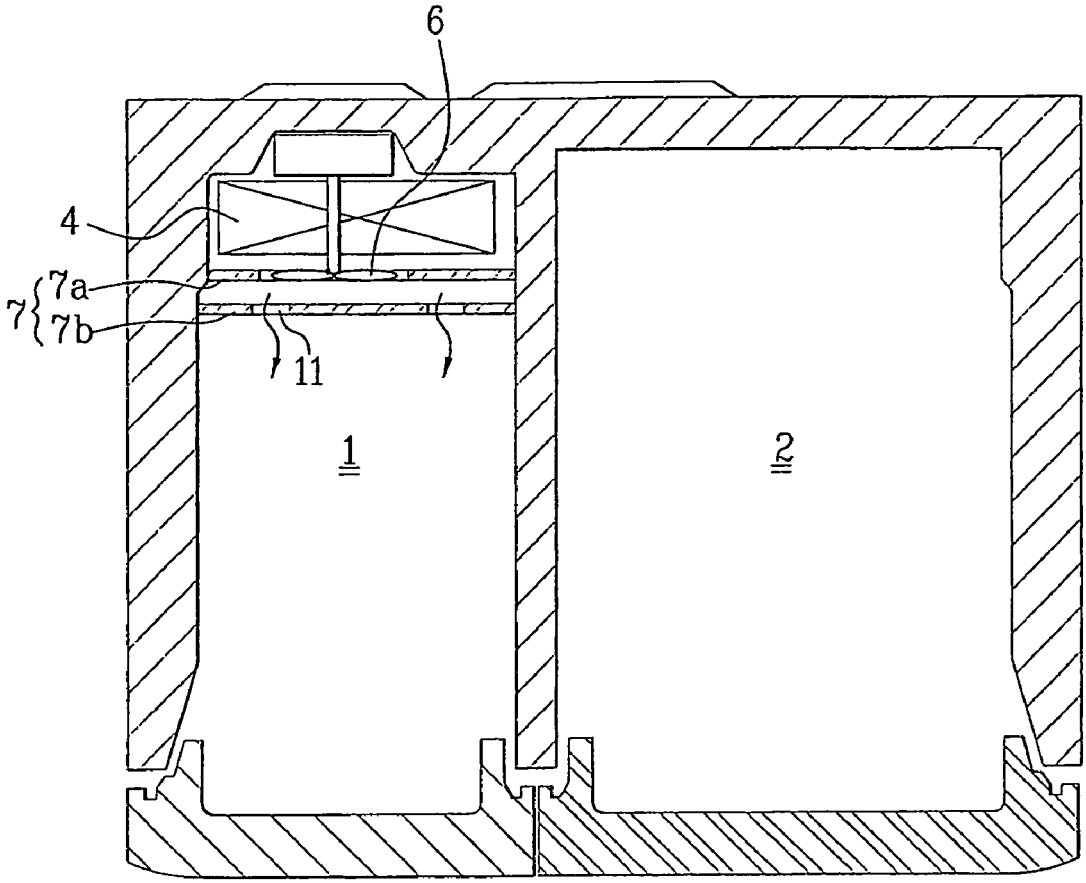
FIG. 2B Prior Art
FIG. 2B illustrates a section across a line II-II in FIG. 1.
Figure 3:
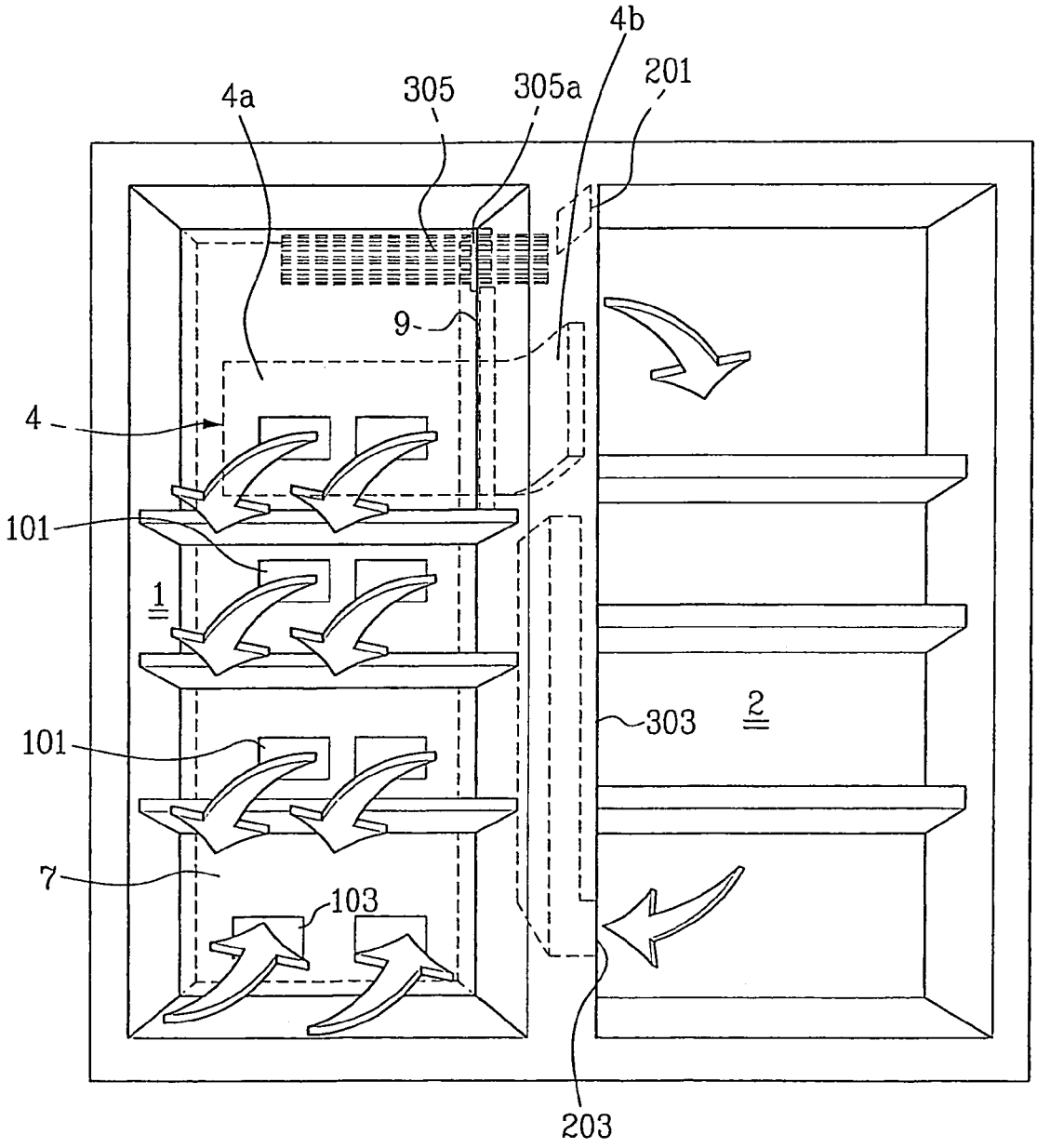
FIG. 3 illustrates a perspective view of a refrigerator in accordance with a first preferred embodiment of the present invention.
Figure 4:
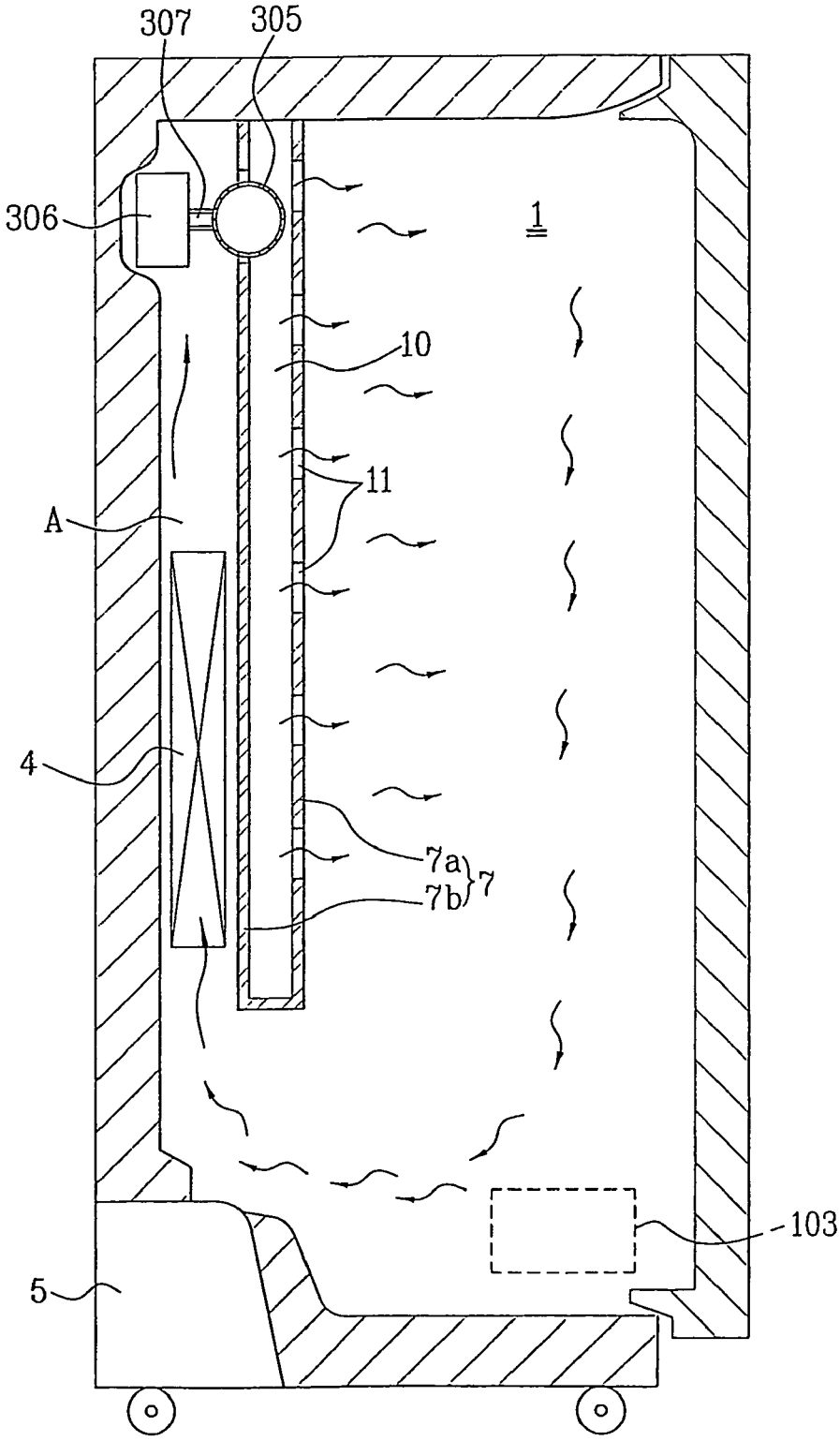
FIG. 4 illustrates a side sectional view of FIG. 3, schematically.
Figure 5:
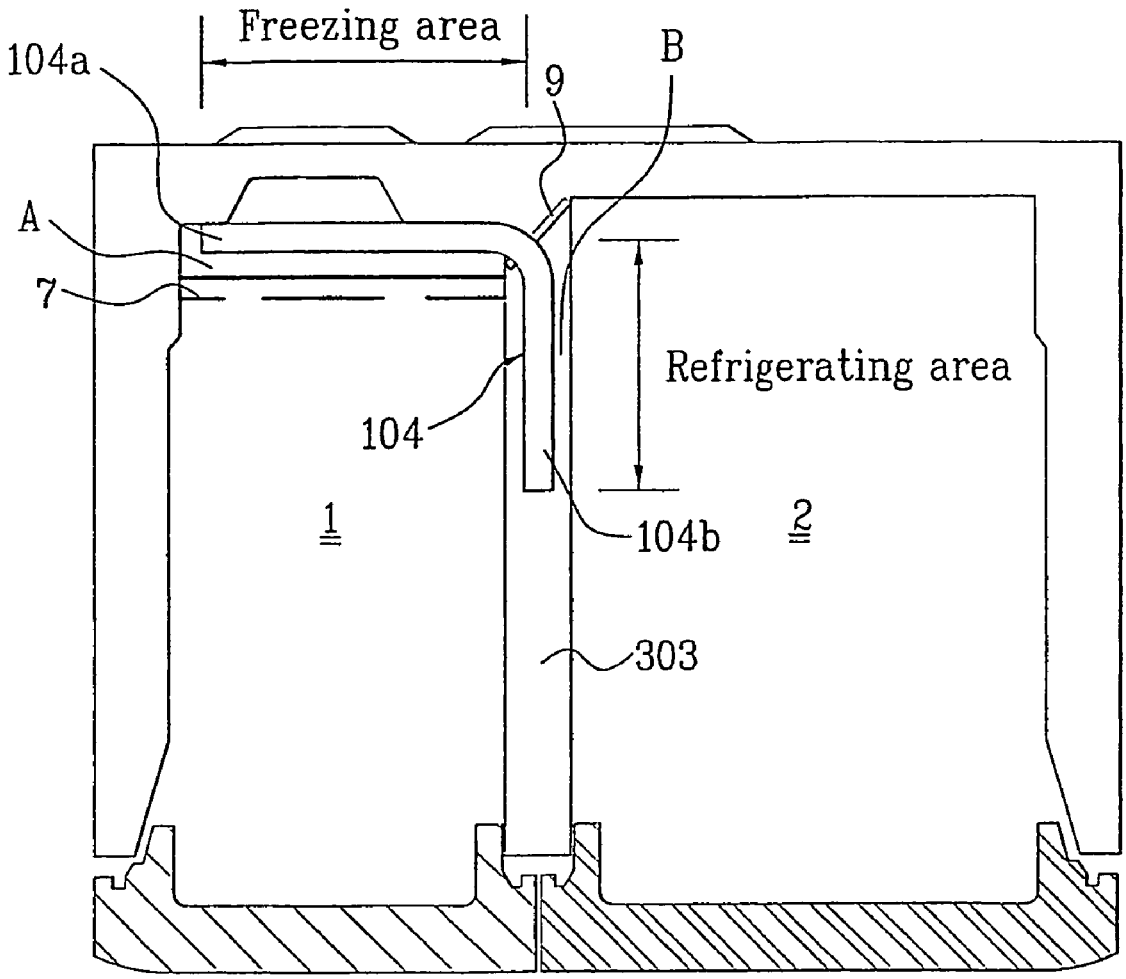
FIG. 5 illustrates a cross sectional view of FIG. 3, schematically.
Figure 6:
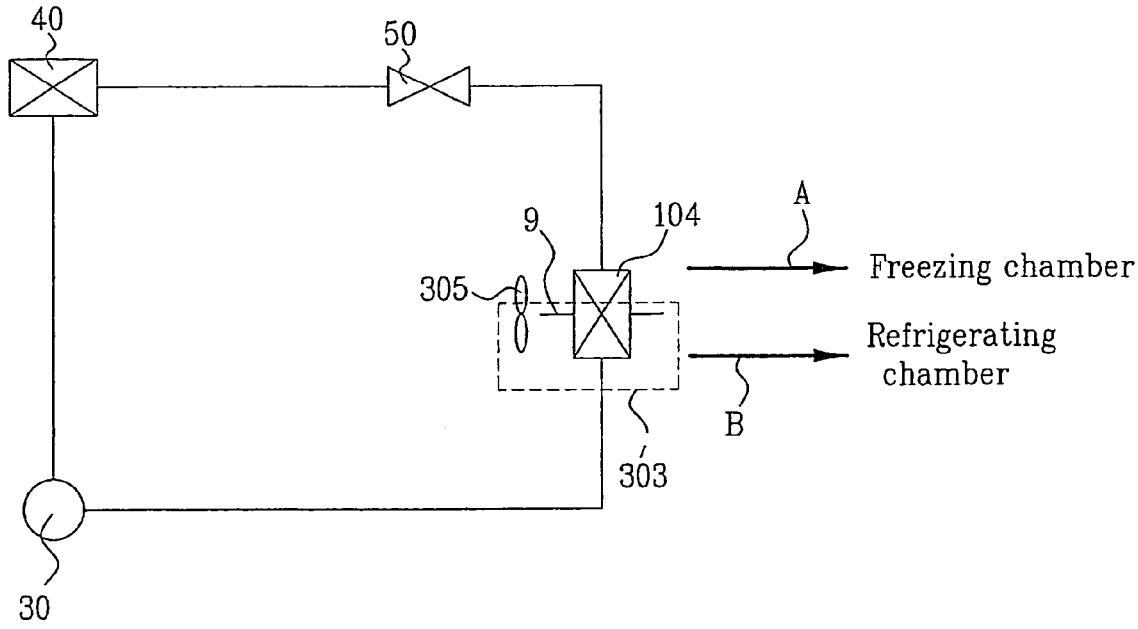
FIG. 6 illustrates a reference diagram for describing a refrigerator in accordance with a first preferred embodiment of the present invention in relation to a refrigerating cycle.

FIG. 3 illustrates a perspective view of a refrigerator in accordance with a first preferred embodiment of the present invention, FIG. 4 illustrates a side sectional view of FIG. 3 schematically, FIG. 5 illustrates a cross sectional view of FIG. 3 schematically, FIG. 6 illustrates a reference diagram for describing a refrigerator in accordance with a first preferred embodiment of the present invention in relation to a refrigerating cycle.

The refrigerator of the present invention includes a freezing chamber 1, a refrigerating chamber 2, a barrier 303, a '¬' form of evaporator 104, cold air passages A, and B for guiding cold air to the chambers, and a fan 305.

The freezing chamber 1 is provided for frozen storage of food, and the refrigerating chamber 2 is provided at one side of the freezing chamber 1. There is the freezing chamber cold air passage 'A' in rear of the freezing chamber 1 compartmentalized with a partition plate 7.

The barrier 303 between the freezing chamber 1 and the refrigerating chamber 2 separates the chambers, and provides a cold air passage 'B' for the refrigerating chamber therein.

Since the evaporator 104 of the present invention has the '¬' form bent along rear of the freezing chamber 1 and the barrier 303, the evaporator 104 is exposed both to the freezing chamber cold air passage 'A' and the refrigerating chamber cold air passage 'B'.

There is a partition wall 9 at an angled part of the '¬' form bent of the evaporator 104 for dividing the evaporator 104 into a freezing chamber side and a refrigerating side, and the freezing chamber cold air passage 'A' and the refrigerating chamber cold air passage 'B' are provided independent from each other by the partition wall 9 for guiding cold air to the freezing chamber 1 and the refrigerating chamber 2, separately. A first part 4*a* of the evaporator 104 in rear of the freezing chamber 1 heat exchanges with the cold air circulating the freezing chamber 1, and a second part 4*b* in the barrier 303 heat exchanges with the cold air circulating the refrigerating chamber 2.

In general, since a heat exchange rate for freezing is greater than a heat exchange rate for refrigerating, a heat exchange area of the first part 104*a* is greater than the same of the second part 104*b*. A difference of the areas can be calculated from a difference of the heat exchange rates for the freezing chamber 1 and the refrigerating chamber 2.

Referring to FIGS. 4 and 5, the freezing chamber cold air passage 'A' guides the cold air passed through the first part 104*a* partitioned with the partition plate 7 and the partition wall 9 to the freezing chamber 1, and the refrigerating chamber cold air passage 'B' guides the cold air passed through the second part 104*b* partitioned with the partition plate 7 and the partition wall 9 to the refrigerating chamber 2.

In the meantime, the fan 305 is mounted over the freezing chamber cold air passage 'A' and the refrigerating chamber cold air passage 'B', and is preferably a cross flow fan for blowing the cold air over the freezing chamber cold air passage 'A' and the refrigerating chamber cold air passage 'B'. That is, a cross flow fan 305 extended in an axial direction is mounted such that one side thereof is exposed to the freezing chamber cold air passage 'A', and the other side thereof is exposed to the refrigerating chamber cold air passage 'B'. The cross flow fan 305 has a separation plate 305*a* between the freezing chamber cold air passage 'A' and the refrigerating chamber cold air passage 'B', for independent discharge of the cold air to the freezing chamber 1 and the refrigerating chamber 2.

The cross flow fan 305 is driven connected to a motor 306 with a belt 307, has a high flow rate and low noise, and is exposed over the freezing chamber cold air passage 'A' and the refrigerating chamber cold air passage 'B', leading to simplify a system of the refrigerator while an efficiency of the refrigerator is enhanced. There is a refrigerating chamber cold air discharge opening 201 with a damper (not shown) for opening/closing the cold air flow. That is, the temperature of the refrigerating chamber 2 reaches to a proper level so as not to require cooling any more, the damper is closed, to stop unnecessary heat exchange at the second part 104*b* of the evaporator.

Referring to FIGS. 3 and 4, the partition plate 7 in rear of the freezing chamber 1 compartmentalizes a space the evaporator 104 is mounted therein. The partition plate 7 includes two layers of a front plate 7*a* and a rear plate 7*b*, between which a cold air passage 10 is formed. The partition plate 7 has a plurality of cold air discharge openings 101, and cold air suction openings 103 in a lower part for introduction of the cold air circulated through, and heat exchanged at, the freezing chamber 1 into the evaporator 104 again.

The cold air blown by the cross flow fan 305 from the freezing chamber cold air passage 'A' is spread uniformly to respective regions of the cold air passage 10 inside of the partition plate 7, and discharged to the freezing chamber 1 through the cold air discharge openings 101. The cold air circulates through, and heat exchanges, in the freezing chamber 1, and returns to the freezing chamber cold air passage 'A' through the cold air suction openings 103 in the lower part of rear of the freezing chamber 1. Thereafter, the cold air is circulated between the evaporator 104 and the freezing chamber by the cross flow fan 305, repeatedly.

The evaporator 104 is a fin-tube type heat exchanger. The fin-tube type heat exchanger has thin plate fins of aluminum or the like closely attached to an outside circumferential surface of a tube the refrigerant flows therein, for increasing a heat exchange surface. Since the fin-tube type heat exchanger can be bent along the tube, the fin-tube type heat exchanger is bent in the "ㄱ" form.

A heat exchange area of the evaporator 104 is divided by the partition wall 9.

Referring to FIGS. 3 and 5, the partition wall 9, fitted vertically along the bent part of the evaporator 104, divides the evaporator 104 into the first part 104*a* and the second part 104*b*, and is connected to the separation plate 305*a* in the cross flow fan 305. Therefore, the cold air respectively passing through the first part 104*a* and the second part 104*b* are separated by the partition wall 9 and the partition plate 305*a*, to heat exchange independently without being mixed.

The first part of the evaporator 104 is in communication with the freezing chamber cold air passage 'A' for supplying the cold air toward the freezing chamber side 1, and the second part is in communication with the refrigerating chamber cold air passage 'B' for supplying the cold air toward the refrigerating chamber 2. That is, the freezing chamber cold air passage 'A' and the refrigerating chamber cold air passage 'B' are in communication with respective parts of the evaporator 104 divided by the partition wall 9. Accordingly, as shown in FIG. 5, the evaporator 104 is connected to the compressor 30, the condenser 40, and the expansion valve 50 to form a refrigerating cycle.

The operation of the side by side type refrigerator in accordance with the first preferred embodiment of the present invention will be described.

Referring to FIGS. 3 to 5, the first embodiment refrigerator has the freezing chamber 1 on a left side of the barrier 303, the refrigerating chamber 2 on a right side of the barrier 303, and the evaporator 104 of the "ㄱ" form bent along the rear of the freezing chamber 1 and the barrier 303. The partition wall 9 is fitted to the bent part of the evaporator 104 between the first part (a freezing chamber side area) 104*a* and the second part (a refrigerating chamber side area) 104*b*. The first part 104*a* is exposed to the freezing-chamber cold air passage 'A', and the second part 104*b* is exposed to the refrigerating chamber cold air passage 'B'.

When the compressor 5 and the cross flow fan 305 come into operation, the cold air from the freezing chamber cold air passage 'A' flows to the freezing chamber uniformly through the plurality of cold air discharge openings 11 in the front plate 7*a* of the partition plate 7 via the cold air passage 10 in the partition plate 7. After circulating through, and heat exchanging in the freezing chamber, the discharge cold air returns to the freezing chamber cold air passage 'A' through the cold air suction openings 103 in the lower part of rear of the freezing chamber 1, again. Thus, the cold air is circulated between the first part 104*a* of the evaporator and the freezing chamber 1 by the cross flow fan 305, repeatedly.

On the other hand, on the refrigerating chamber 2 side, the cold air heat exchanged at the second part 104*b* of the evaporator is discharged to the refrigerating chamber 2 through the cold air discharge openings 201 by the cross flow fan 305. The discharged cold air circulates through, and heat exchanges in the refrigerating chamber 2, and returns to the refrigerating chamber cold air passage 'B' through the cold air suction openings 203 in the lower part of the refrigerating chamber 2. Thus, the cold air circulates between the second part 104*b* of the evaporator and the refrigerating chamber 2, repeatedly.

Therefore, in a case the refrigerating chamber 2 is required to be cooled down further even though a proper temperature condition of the freezing chamber 1 is met, the present invention permits to cool down the refrigerating chamber at a faster cooling rate. That is, by discharging the cold air heat exchanged at the second part 104*b* of the evaporator independently to the refrigerating chamber 2, the refrigerating chamber 2 can be cooled down to a proper temperature, more quickly.

In a case the freezing chamber 1 is required to be cooled down further even though the proper temperature condition of the refrigerating chamber 2 is met, the damper in the discharge opening 201 on the refrigerating chamber 2 side is closed, to prevent unnecessary heat exchange, and to cause a heat exchange concentrated at the first part 104*a*, thereby improving a cooling performance of the freezing chamber 1.

Accordingly, in the separated cooling type refrigerator of the present invention, by dividing the heat exchange area of the evaporator 104, and making the divided areas to be in communication with independent cold air passages A and B respectively, to cool down the freezing chamber 1 and the refrigerating chamber 2 independently, the cooling rate of the refrigerating chamber 2 can be improved, and a volume of the freezing chamber 1 can be increased. That is, by cooling down the freezing chamber 1 and the refrigerating chamber 2 independently, the refrigerator of the present invention can solve the problem of the related art refrigerator in which the cooling rate of the refrigerating chamber is lower than the freezing chamber due to a low flow rate of the cold air passed through the evaporator and supplied to the refrigerating chamber.

Moreover, since the evaporator 104 of the present invention is spread over a large area of the rear of the freezing chamber and the barrier 303, a thickness of the evaporator can be reduced. Accordingly, different from the related art refrigerator, the volume of the freezing chamber 1 can be increased. That is, while reducing the two layers of the evaporator mounted on the freezing chamber side in the related art into one layer, by mounting the evaporator 104 to occupy a large area along the rear of the freezing chamber and the barrier 303, the volume of the freezing chamber 1 can be increased while the volume of the refrigerating chamber 2 is kept the same.

Furthermore, by separating the cold air passages A, and B from each other independently that circulate through the freezing chamber 1 and the refrigerating chamber 2, mixing of smells of the food stored in the freezing chamber 1 and the refrigerating chamber can be prevented.

Furthermore, since the cold air from the freezing chamber 1 and the cold air from the refrigerating chamber 2 do not meet at an inlet side of the evaporator 104, frost formation caused by a temperature difference is reduced, to permit to increase a defrosting period.

Figure 7:
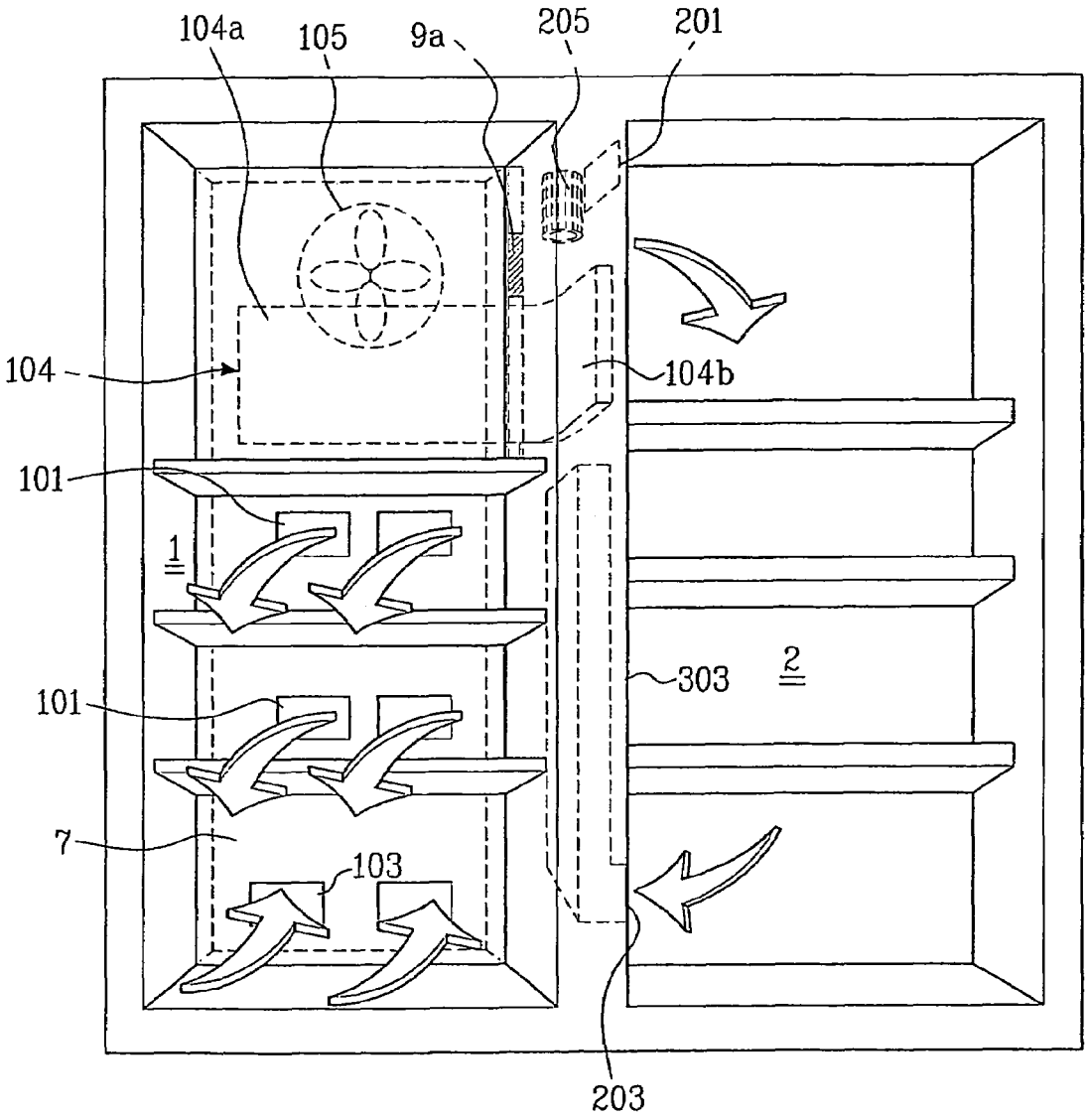
FIG. 7 illustrates a perspective view of a refrigerator in accordance with a second preferred embodiment of the present invention.

A refrigerator in accordance with a second preferred embodiment of the present invention will be described with reference to FIGS. 7 to 9. FIG. 7 illustrates a perspective view of a refrigerator in accordance with a second preferred embodiment of the present invention, FIG. 8 illustrates a cross sectional view of FIG. 7, schematically, and FIG. 9 illustrates a reference diagram for describing a refrigerator in accordance with a second preferred embodiment of the present invention in relation to a refrigerating cycle.

Figure 8:
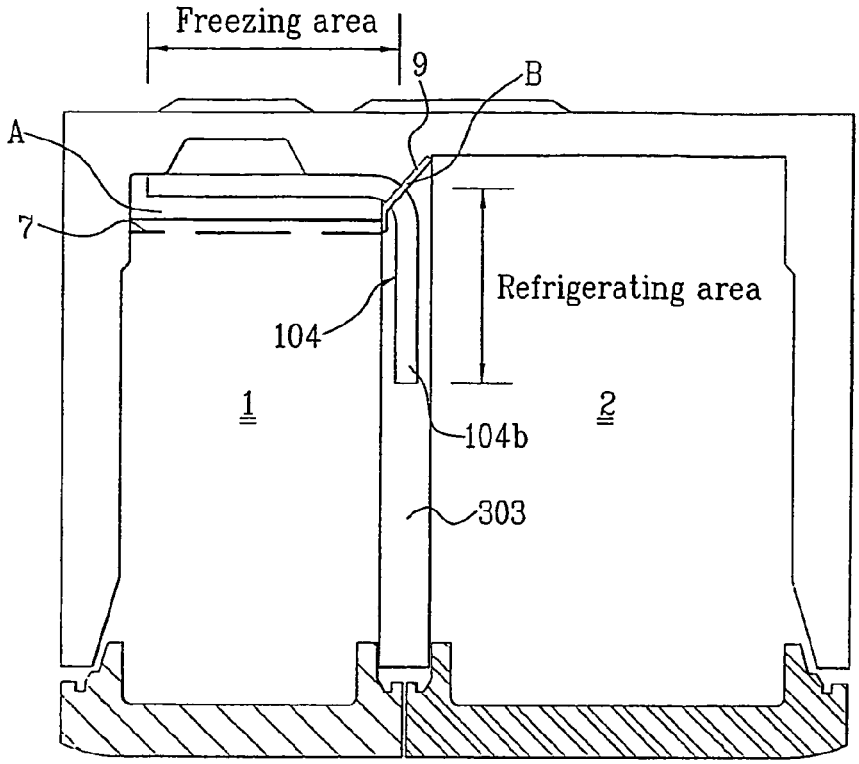
FIG. 8 illustrates a cross sectional view of FIG. 7, schematically.
Figure 9:
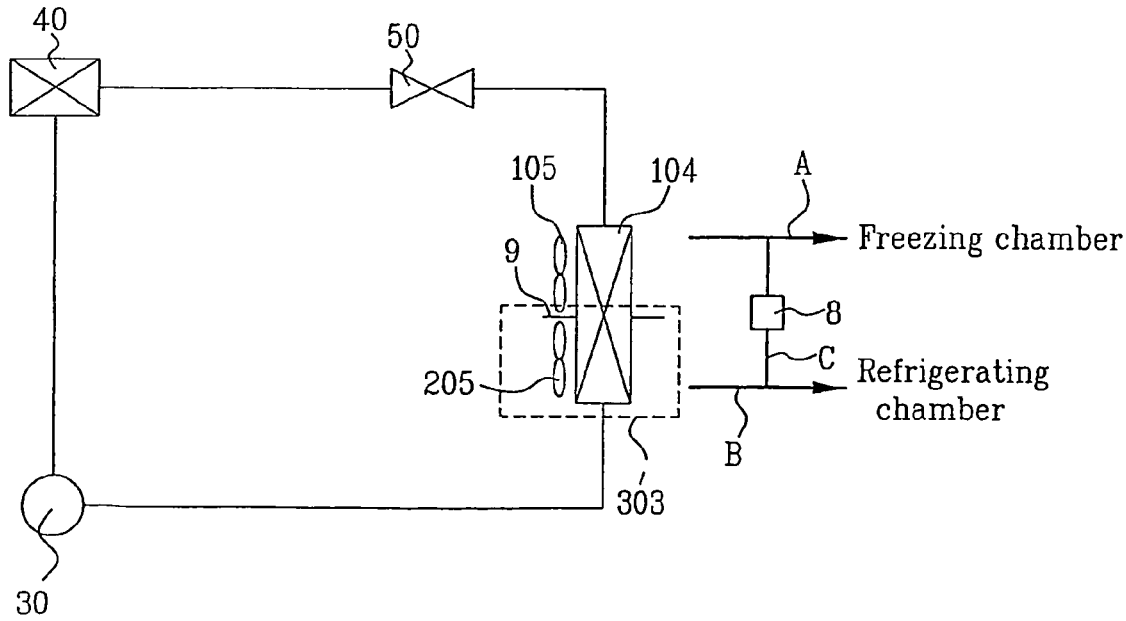
FIG. 9 illustrates a reference diagram for describing a refrigerator in accordance with a second preferred embodiment of the present invention in relation to a refrigerating cycle.

Referring to FIGS. 7 and 8, the refrigerator in accordance with a second preferred embodiment of the present invention includes a freezing chamber 1, a refrigerating chamber 2, a barrier 303, a "¬" form of evaporator 104, a partition wall 9, freezing chamber and refrigerating chamber cold air passages A, and B, and fans 105 and 205 for blowing the cold air flowing through respective cold air passages.

In the refrigerator in accordance with a second preferred embodiment of the present invention, there are all evaporator 104 mounted in a "¬" form along a freezing chamber cold air passage 'A' and the refrigerating chamber cold air passage 'B', and fans 105 and 205 mounted on the freezing chamber cold air passage 'A' and the refrigerating chamber cold air passage 'B' independently for forced circulation of the cold air to respective chambers. That is, in the second embodiment, the fans 105, and 205 are mounted on the freezing chamber cold air passage 'A' and the refrigerating chamber cold air passage 'B' independently, which are controlled, independently.

In the meantime, the freezing chamber cold air passage 'A' and the refrigerating chamber cold air passage 'B' are in communication at one sides thereof, with a damper 9*a* fitted to the part in communication. That is, an opening is formed in one side part of a partition wall 9 that divides the freezing chamber cold air passage 'A' and the refrigerating chamber cold air passage 'B', and a damper 9*a* is fitted to the opening, for selective opening/closing of the opening.

A system of the second embodiment is the same with the system of the first embodiment except fitting structures of the fans 105 and 205 and an opening structure.

The fitting structures of the fans 105 and 205 will be described with reference to FIG. 7.

For appropriate utilization of spaces of the cold air passages A, and B, it is preferable that an axial fan 105 provided to the freezing chamber cold air passage 'A', and a cross flow fan 205 is provided to the refrigerating chamber cold air passage 'B'. Since the freezing chamber cold air passage 'A' has a large area of the partition plate 7, the axial fan 105 having a large frontal area can be mounted for blowing of the cold air. Also, since the refrigerating chamber cold air passage 'B' is in the barrier 303, to require mounting of the fan into a comparatively small space, the cross flow fan 205 is mounted vertically in the axial direction for securing an appropriate flow rate. A cold air discharge opening 201 is formed in a part adjacent to the cross flow fan 205 for circulating the cold air to the refrigerating chamber 2.

Even though the cold air passages A, and B are separated by the partition wall 9, the opening is formed in one side part of the partition wall 9, and the damper 9*a* is provided for selective opening/closing of the opening. Therefore, if the opening is opened, to permit the cold air flowing through respective cold passages A, and B to mix, the cooling rates can be balanced in a case the freezing chamber 1 and the refrigerating chamber 1 are cooled at the same time. Moreover, in a case either one of the freezing chamber 1 and the refrigerating chamber 2 is cooled, by closing the damper 9*a*, driving the fan for the chamber that requires cooling, and stopping the fan for the chamber of which temperature condition is met, the cooling can be carried out to meet different conditions, independently.

The operation of the side by side type refrigerator in accordance with a second preferred embodiment of the present invention will be described.

It is preferable that the damper 9*a* on the opening of the partition wall 9 is opened in a case the freezing chamber 11 and the refrigerating chamber 2 are cooled at the same time. Both the axial flow fan 105 on the freezing chamber cold air passage 'A' and the cross flow fan 205 on the refrigerating chamber cold air-passage 'B' blow the cold air. The cold air heat exchanges at the evaporator 104, and circulates through, and cools down, the freezing chamber 1 and the refrigerating chamber 2, respectively.

Thereafter, once the temperature condition of one of the chambers is met, the damper 9*a* to the opening is closed, and the fan for the chamber of which temperature condition is met is stopped. On the other hand, the fan for the other chamber is kept driven until the temperature condition is met.

The refrigerator is operated thus, and others are the same with the first embodiment.

Meantime, alike the first embodiment, the separated cooling type refrigerator in accordance with a second preferred embodiment of the present invention has a cold air circulation structure in which the freezing chamber side and the refrigerating chamber side are independent from each other, increases the volume of the freezing chamber 1, and has an improved cooling rate, to improve a defrosting time period.

However, since the second embodiment refrigerator has two fans, permitting to stop the fan of which temperature condition is met, power consumption can be reduced, effectively.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The refrigerator of the present invention has the following advantages.

First, the freezing chamber and the refrigerating chamber can be cooled, independently. Particularly, according to the second embodiment, because the damper can be closed once one of the freezing chamber and the refrigerating chamber meets the temperature condition at first, to permit concentration of the cold air to the other chamber of which temperature condition is not met, a cooling efficiency can be enhanced, and power consumption can be reduced.

Second, since the fan for the refrigerating chamber is provided, permitting forced supply of the cold air to the refrigerating chamber, to increase a flow rate to the refrigerating chamber, the cooling rate of the refrigerating chamber can be improved.

Third, since the cold air from the freezing chamber and the refrigerating chamber do not meet at the inlet to the evaporator, to reduce frost caused by a temperature difference, the defrosting time period can be prolonged.

Fourth, the "¬" formed evaporator mounted to occupy a large area along the rear of the freezing chamber and the barrier, permitting the evaporator thinner, the volume of the freezing chamber can be increased while the volume of the refrigerating chamber is kept the same.

Fifth, the separated cold air passages for the freezing chamber and the refrigerating chamber prevent mixing of food smells stored in the freezing chamber and the refrigerating chamber.

What is claimed is:

1. A refrigerator comprising:

a freezing chamber;

a refrigerating chamber at a side of the freezing chamber;

a barrier between the freezing chamber and the refrigerating chamber, the barrier having a refrigerating chamber cold air passage formed therein;

a partition plate for compartmentalizing a freezing chamber cold air passage in rear of the freezing chamber;

an evaporator; a partition wall between the freezing chamber cold air passage and the refrigerating chamber cold air passage, the evaporator passing through the partition wall such that the evaporator is exposed to the freezing chamber cold air passage and the refrigerating chamber cold air passage; and a fan mounted over the freezing chamber cold air passage and the refrigerating chamber cold air passage for discharging cold air flowing through respective cold air passages to the freezing chamber and the refrigerating chamber, respectively, wherein the evaporator includes a first part exposed to the freezing chamber cold air passage, and a second part exposed to the refrigerating chamber cold air passage, wherein an outer surface of the first part and the second part is separated by the partition wall for preventing the cold air flowing through respective parts from mixing with each other, and wherein the second part is located within the barrier.

2. The refrigerator as claimed in claim 1, wherein the first part is larger than the second part.

3. The refrigerator as claimed in claim 1, wherein the partition plate includes a front plate and a rear plate, to form a cold air passage between the plates.

4. The refrigerator as claimed in claim 3, wherein the front plate has a plurality of cold air discharge openings formed therein.

5. The refrigerator as claimed in claim 3, wherein the rear plate has an opening in an upper part thereof, and the fan is provided adjacent to the opening.

6. The refrigerator as claimed in claim 3, wherein the partition plate has openings in a lower part thereof to form cold air suction openings.

7. The refrigerator as claimed in claim 1, wherein the fan is a cross flow fan.

8. The refrigerator as claimed in claim 7, wherein the cross flow fan has one side exposed to the freezing chamber cold air passage, and the other side exposed to the refrigerating chamber cold air passage.

9. The refrigerator as claimed in claim 7, wherein the first part is separated from the second part by a separation plate.

10. The refrigerator as claimed in claim 7, wherein the refrigerating chamber cold air passage has a cold air discharge opening above a part adjacent to the cross flow fan.

11. The refrigerator as claimed in claim 10, wherein the cold air discharge opening has a damper provided thereto for opening/closing the cold air discharge opening.

12. The refrigerator as claimed in claim 1, wherein the barrier has cold air suction openings in a lower part of a refrigerating chamber side thereof in communication with the refrigerating chamber cold air passage.

13. The refrigerator as claimed in claim 1, wherein the evaporator is a one layered fin-tube type heat exchanger.

14. A refrigerator comprising:

a freezing chamber;

a refrigerating chamber at a side of the freezing chamber;

a barrier between the freezing chamber and the refrigerating chamber, the barrier having a refrigerating chamber cold air passage formed therein;

a partition plate for compartmentalizing a freezing chamber cold air passage in rear of the freezing chamber;

an evaporator;

a partition wall between the freezing chamber cold air passage and the refrigerating chamber cold air passage, the evaporator passing through the partition wall such that the evaporator is exposed to the freezing chamber cold air passage and the refrigerating chamber cold air passage; and fans respectively provided to the freezing chamber cold air passage and the refrigerating chamber cold air passage for forced circulation of cold air to the freezing chamber and the refrigerating chamber, respectively, wherein the evaporator includes a first part exposed to the freezing chamber cold air passage, and a second part exposed to the refrigerating chamber cold air passage, wherein the first part and the second part are separated by the partition wall for preventing the cold air flowing through respective parts from mixing with each other, and wherein the second part is located within the barrier.

15. The refrigerator as claimed in claim 14, wherein the freezing chamber cold air passage and the refrigerating chamber cold air passage are in communication with each other at one sides thereof, and a damper is provided in a part of the communication is made.

16. The refrigerator as claimed in claim 14, wherein the first part is larger than the second part.

17. The refrigerator as claimed in claim 14, wherein the partition plate includes a front plate and a rear plate, to form a cold air passage between the plates.

18. The refrigerator as claimed in claim 17, wherein the front plate has a plurality of cold air discharge openings formed therein.

19. The refrigerator as claimed in claim 17, wherein the rear plate has an opening in an upper part thereof, and the fan is provided adjacent to the opening.

20. The refrigerator as claimed in claim 17, wherein the partition plate has openings in a lower part thereof to form cold air suction openings.

21. The refrigerator as claimed in claim 17, wherein one of the fans in the freezing chamber cold air passage is an axial flow fan, and another one of the fans in the refrigerating chamber cold air passage is a cross flow fan.

22. The refrigerator as claimed in claim 21, wherein the refrigerating chamber cold air passage has a cold air discharge opening in a part adjacent to the cross flow fan.

23. The refrigerator as claimed in claim 22, wherein the cold air discharge opening has a damper provided thereto for opening/closing the cold air discharge opening.

24. The refrigerator as claimed in claim 14, wherein the barrier has cold air suction openings in a lower part of a refrigerating chamber side thereof in communication with the refrigerating chamber cold air passage.

25. The refrigerator as claimed in claim 14, wherein the evaporator is a one layered fin-tube type heat exchanger.

26. The refrigerator as claimed in claim 1, wherein the evaporator has an L shape.

27. The refrigerator as claimed in claim 1, wherein a combination of the first part and the second part forms an L shape structure.

28. The refrigerator as claimed in claim 14, wherein the evaporator has an L shape.

29. The refrigerator as claimed in claim 14, wherein a combination of the first part and the second part forms an L shape structure.

* * * * *